US007444799B2

(12) United States Patent
Menegatto

(10) Patent No.: US 7,444,799 B2
(45) Date of Patent: Nov. 4, 2008

(54) FEEDER APPARATUS FOR THE AUTOMATIC INSERTION OF YARN

(75) Inventor: Carlo Menegatto, Milan (IT)

(73) Assignee: Menegatto S.R.L., Milan (IT)

( * ) Notice: Subject to any disclaimer, the term of this patent is extended or adjusted under 35 U.S.C. 154(b) by 190 days.

(21) Appl. No.: 11/482,875

(22) Filed: Jul. 10, 2006

(65) Prior Publication Data

US 2007/0227115 A1 Oct. 4, 2007

(30) Foreign Application Priority Data

Apr. 3, 2006 (IT) ..... MI2006A0648

(51) Int. Cl.
*D01H 13/00* (2006.01)

(52) U.S. Cl. ..... 57/90

(58) Field of Classification Search ..... 57/22, 57/90, 261

See application file for complete search history.

(56) References Cited

U.S. PATENT DOCUMENTS 6,840,032 B2 * 1/2005 Zenker ..... 57/280
7,310,932 B2 * 12/2007 Liao ..... 57/210
2003/0005682 A1 * 1/2003 Jen ..... 57/289
2004/0118099 A1 * 6/2004 Zewde et al. ..... 57/244
2004/0182066 A1 * 9/2004 Zenker ..... 57/280
2006/0042220 A1 * 3/2006 Maccabruni et al. ..... 57/264
2006/0131459 A1 * 6/2006 Barea ..... 242/554

* cited by examiner

*Primary Examiner*—Shaun R Hurley
(74) *Attorney, Agent, or Firm*—Young & Thompson

(57) ABSTRACT

Feeder apparatus for the automatic insertion of added yarn according to the present invention, of the type suitable for being installed on textile machines provided with at least one support creel for the bobbin of base yarn and automatic change of the spool of combined yarn, comprising at least one first and one second unit for feeding the added yarn, means for directing said added yarn and means for coupling the added yarn with the base yarn to form the combined yarn, characterised in that each unit for feeding the added yarn consists of a reel of added yarn placed on support means in contact with a motorised feed roller, in such a way that each feed unit is provided with its own feed roller and is independent from the others, and relative method.

14 Claims, 2 Drawing Sheets

FEEDER APPARATUS FOR THE AUTOMATIC INSERTION OF YARN

FIELD OF THE INVENTION

The invention relates to the sector of textile machines, and in particular the invention relates to an automatic feeder for the insertion of stretch yarn on the base yarn for a generic textile machine provided with the device for automatic change of the spool of combined yarn.

BACKGROUND OF THE INVENTION

Nowadays a plurality of clothing items made wholly or partially with stretch fabrics are available on the market, in that these fabrics best adapt to the curves of the wearer, and in some cases have definitely higher resistance to deformation and wear compared to traditional fabrics. These stretch fabrics are made from yarns formed by a base yarn to which stretch yarns are added in various ways. For example, for the production of tights, stretch yarns are used, combined with a base yarn, for example of cotton or nylon, which are later bonded one to the other to form the processed stretch yarn. There are various possible processes, such as interlacing, covering or twisting, and each of them is carried out by specific machines.

Currently the generic textile machine for processing the base yarn consists of a certain number of work stations in parallel, each of which performs a specific operation. More particularly the textile machine has a number of creels provided with the same number of bobbins of base yarn, rotated by a feed roller, and at least one reel of stretch yarn mounted on a special support structure, also rotated by another feed roller. The individual yarns, which come respectively from the bobbin of the base yarn and from the reel of the stretch yarn, are then coupled and wound successively on the reel of combined yarn.

Currently the textile machines available commercially provide for the use of a single feed roller of the reels of stretch yarn, powered by a single motor, for all the stations in parallel that wind the spool of combined yarn. This solution, although advantageous from the economic standpoint in that it involves the presence of a single motor, is often found to be the source of problems. The stretch yarn in fact tends to be wound wrongly on the winder roller, forming the so-called "weaver's waste", that is to say a massive residue around the roller which is to be removed to avoid possible breakages of the same machine. For removal of the waste, therefore, the whole line of machines is put on hold as the feed roller is the same for all of them. This disadvantage occurs sufficiently frequently to affect the yield of the textile machinery, lowering it considerably. Another problem that occurs in the sector of textile machines relates to the fact that, when the reel of stretch yarn is finished, an operative takes considerable time to replace the same, and production at the same time must be stopped. This problem has been solved with the provision of the automatic change of the spool of combined yarn and with the addition of at least one second reel of stretch yarn, which is hooked to the base yarn as soon as the first reel is finished, at the same time as the automatic spool change. The two reels of stretch yarn are generally mounted on a drum support with automatic rotation, in such a way that a reel is always in contact with the single roller for feeding the stretch yarn. When a reel is used up, the drum performs a rotation with, for example, pneumatic control, bringing the second reel in contact with the feed roller. The limitation of this solution is once again the presence of a single feed roller, whose uniqueness is a critical factor for the reasons stated above, and moreover the fact that the rotating drum involves the presence of an assembly of moving parts, and therefore greater bulk and the presence of further shearing points, very dangerous for the operative. The Applicant, with a view to increasing the availability of textile machines, has developed feeder apparatus for the automatic insertion of stretch yarn for textile machines provided with automatic spool change which overcomes all the aforementioned limitations of the prior art.

The object of the present invention is that of providing feeder apparatus for the automatic insertion of stretch yarn which can be installed on various types of textile machines, provided they are equipped with automatic change of the spool of combined yarn, in that it has reduced dimensions and does not entail complex modifications to the existing machine.

Another object of the present invention is that of providing feeder apparatus for the automatic insertion of stretch yarn for textile machines provided with automatic spool change, wherein each reel of stretch yarn operates independently from the other so as to guarantee the line of machines a continuity of production also in the case of localised faults or breakdowns.

An additional object of the present invention is that of a providing feeder apparatus for the automatic insertion of stretch yarn for textile machines provided with automatic spool change, wherein there are no mechanical or pneumatic members for the movement of the packs of stretch yarn.

A last but no less important object of the present invention is that of providing feeder apparatus for the automatic insertion of stretch yarn that is extremely simplified and safe for the operative, in that it has a reduced number of shearing points.

SUMMARY OF THE INVENTION

All these objects are achieved by the feeder apparatus for the automatic insertion of added yarn according to the present invention, of the type suitable for being installed on textile machines provided with at least one support creel for the bobbin of base yarn and automatic change of the spool of combined yarn, comprising at least one first and one second unit for the feeding of the added yarn, means for directing said added yarn, and means for coupling the added yarn with the base yarn to form the combined yarn, characterised in that each unit for feeding added yarn consists of a reel of added yarn placed on support means in contact with a motorised feed roller, in such a way that each feed unit is provided with its own feed roller and is independent from the others.

BRIEF DESCRIPTION OF THE DRAWINGS

The present invention will be made clearer by the following reading of a preferred embodiment of the feeder apparatus, illustrated by way of a non-limiting example of the more general principle claimed. The description refers to the illustrations of the accompanying drawings, wherein:

DESCRIPTION OF THE PREFERRED EMBODIMENT

Figure 1:
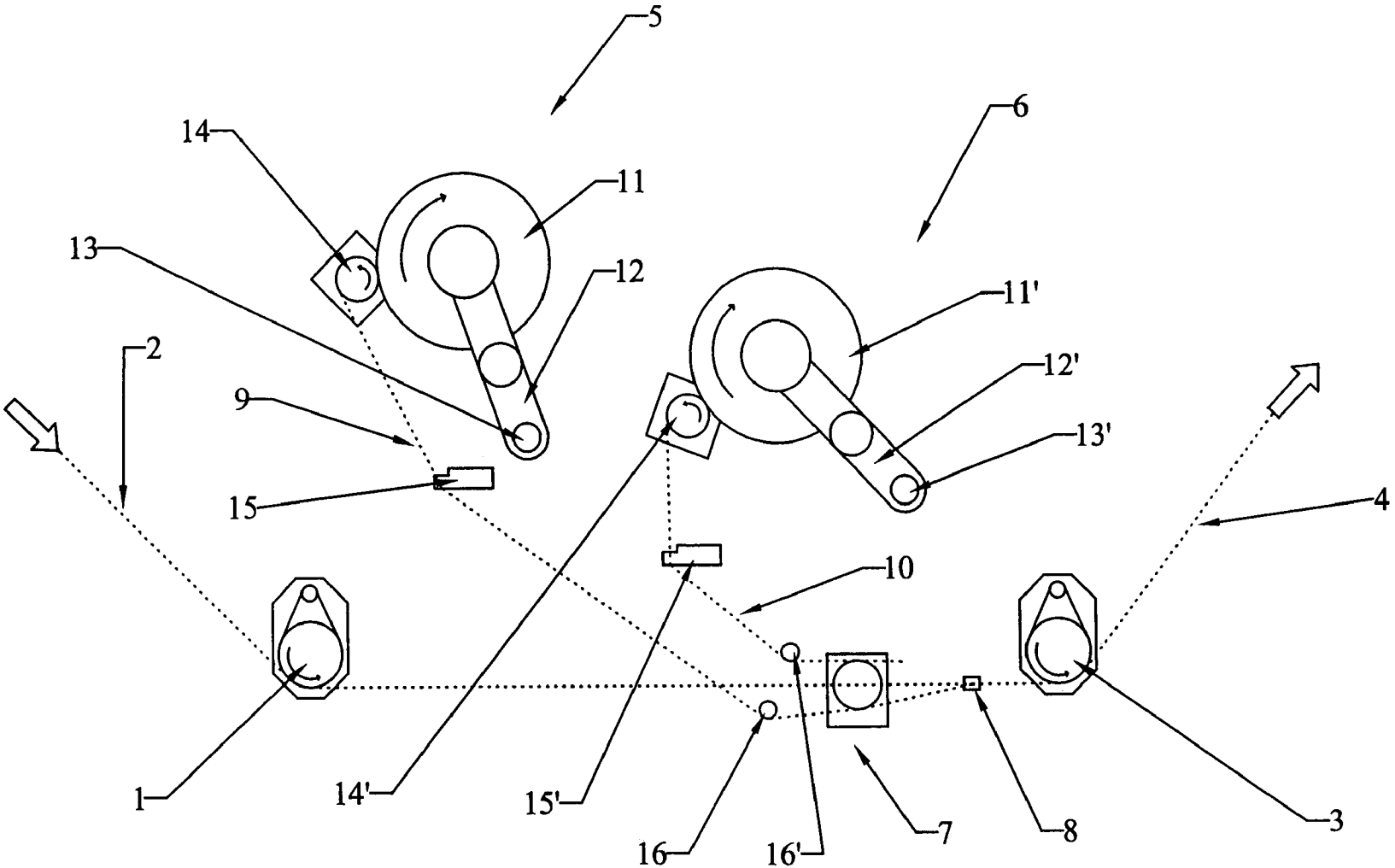
FIG. 1 shows a front schematic view of the feeder apparatus according to the present invention.

Referring to FIG. 1, the feeder apparatus for the automatic insertion of added yarn is substantially formed by a first feed roller 1 of the base yarn 2, a second feed roller 3 of the combined yarn 4, a first and a second feed unit 5, 6 for the added yarn, the device for insertion of the ends 7 and the conveying element 8. The base yarn 2 is fed by a bobbin mounted rotatingly on a special creel, not shown in the drawings, which is unwound in the direction indicated in the drawing through the action of the first feed roller 1. At the height of the device for insertion of the ends 7 the base yarn 2 is coupled to the added yarn which in the example is a stretch yarn 9, 10 such as for example LYCRA™, to form the combined yarn 4 which is later taken, through the action of the second feed roller 3, to the subsequent phases of processing in the direction indicated in the drawing. The stretch yarn 9, 10 is supplied by a first and a second feed unit 5, 6 that are structurally identical, in the manner that will be explained in detail herein below. Each feed unit 5, 6 comprises a reel of stretch yarn 11, 11' mounted rotatingly on suitable support means, which in the embodiment described are a support arm 12, 12' mounted on the frame of the textile machine, not shown, fitted with a spring release device 13, 13' of the known type, the feed roller 14, 14', the yarn presence sensor 15, 15' and at least one ceramic deviator 16, 16'. The support arm 12, 12' maintains the reel of the stretch yarn 11, 11' in contact with the feed roller 14, 14' which has its own motor drive and is independent in relation to the feed rollers 1, 3 and all the other rollers that may be installed on the textile machine. Said roller 14, 14' can be advantageously mounted directly on the frame of the textile machine, without particular and complex changes to the same. The feed roller 14, 14' unwinds at constant tightness and speed the stretch yarn 9, 10 which traverses the yarn presence sensor 15, 15' and converges without forming corners at the device for insertion of the ends 7 thanks to the ceramic deviator 16, 16'. The combined yarn 4, through the ceramic conveyor 8, then abandons the feeder apparatus, moved by the second feed roller 3 in the direction indicated in FIG. 1.

The feeder apparatus for the automatic insertion of stretch yarn of the preferred embodiment of the present invention is provided with two feed units 5, 6 as described above. The presence of at least two reels of stretch yarn 11, 11' performs the task of maintaining the machine operative even when a reel of stretch yarn is used up. In this case the yarn presence sensor 15, 15' sends a signal to the control electronics of the textile machine, which consequently performs both the automatic change of the spool of combined yarn and the automatic change of the reel of stretch yarn. Advantageously, during this change operation, the base yarn continues to be unwound and the textile machine is not stopped.

Figure 2:
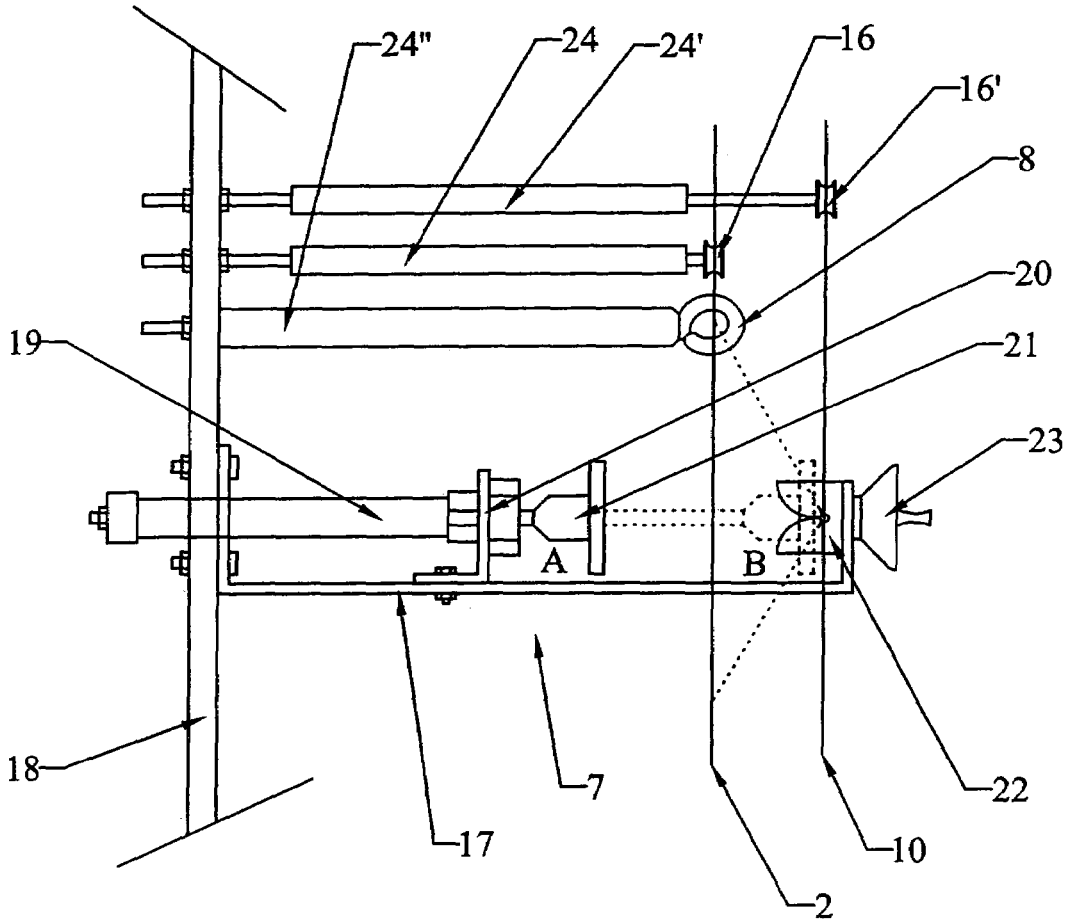
FIG. 2 shows a side schematic view of a detail of the feeder apparatus according to the present invention.

In order to carry out the first loading of the stretch yarn 9, 10, the operative takes two reels of stretch yarn 11, 11' and places them on the relative support arms 12, 12', which place the reels in contact with the respective feed rollers 14, 14'. The operative then takes by hand the stretch yarn 9 of the first feed unit 5, makes it pass through the yarn presence sensor 15 and into the ceramic deviator 16 and combines it with the base yarn 2, in that the stretch yarn is substantially sticky. At this point the feed rollers 1, 3 and 11 for the base yarn and the stretch yarn 9 are started up, and the combined yarn 4 is inserted in the ceramic conveyor 8 and is made to run over the second feed roller 3. At this point the operative takes the stretch yarn 10 of the second feed unit 6, passes it through the relative yarn presence sensor 15' and into the ceramic deviator 16', and finally inserts it in the device for insertion of the ends 7, which performs the function of coupling the base yarn 2 with the stretch yarn 9, 10 in the manner which is to be explained herein below. Referring to FIG. 2, the device for insertion of the ends 7 comprises an upright 17 with a U shape, attached at one end to the frame 18 of the textile machine, and a pneumatic cylinder 19 with horizontal axis. The pneumatic cylinder 19 is maintained in position at one end by the same frame 18 of the textile machine and by the bracket 20 integral with said upright 17. At the mobile end of the pneumatic cylinder 19 the presser element 21 is placed, with a plate shape, which is moved horizontally by the pneumatic thrust of the cylinder 19. At the opposite end of the upright 17 in relation to the frame 18 of the textile machine a fork-shaped device 22 is placed, whose inlet has an axis placed on a horizontal plane, and the stop button 23 for the stretch yarn. The operative runs the stretch yarn 10 through the inlet of the fork-shaped device 22 and then blocks its free end thanks to the stop button 23 fitted with a small return spring. The stretch yarn 10 then remains in a waiting position while the textile machine consumes the stretch yarn 9 of the reel of stretch yarn 11. When the reel of stretch yarn 11 uses up the yarn, the yarn presence sensor 15 sends the signal to the control electronics of the textile machine, which consequently actuates the pneumatic cylinder 19 which moves the presser element 21 outwards from the internal position A to the external position B of FIG. 2. In this way said presser element 21 pushes the base yarn 2 inside the fork-shaped device 22, until it touches the stretch yarn 10 in the waiting position. A jet of air coming from a gun device not shown in the drawings welds the stretch yarn 10 to the base yarn 2, which draws it with itself towards the second feed roller 3. At the same time the textile machine carries out the automatic change of the spool of combined yarn, and is wound on a new spool. The pneumatic cylinder 19 returns the presser element 21 into the internal position A thanks to a return mechanism. The operative at this point replaces the used-up reel of stretch yarn 11 by hand, and places the stretch yarn 9 by hand on hold in the device for insertion of the ends 7. This operation is repeated cyclically whenever a reel of stretch yarn is used up, with clear saving of time and increase in productivity, in that the textile machine never stops the rollers for feeding the base yarn.

Advantageously, as can be seen by consulting FIG. 2, the ceramic deviators 16, 16' and the ceramic conveyor 8 are directly connected to the frame of the textile machine by means of the same number of rod-shaped elements 24, 24', 24". In this way the added yarn feeder apparatus can be mounted on any textile machine as retrofit equipment, in that it is small in size and does not entail complex changes to the existing system.

It is clear that the added yarn feeder apparatus according to the present invention fulfils the objects declared in full, in that each added yarn feed unit is provided with an independent feed roller which, in the event of malfunctioning, does not influence the operations and availability of the entire production line. The automatic change of the reel of added yarn eliminates the disadvantage of having to stop the machine to carry out the change thereof, which is performed automatically without moving mechanical members.

It is obviously understood that each known device, which in the preferred embodiment described above is part of the feeder apparatus according to the invention, can be replaced by any equivalent alternative, or several feed units can be provided according to the type of combined yarn to be obtained, without the apparatus obtained in this way departing substantially from the principles claimed herein below.

What is claimed is:

1. Feeder apparatus for the automatic insertion of added yarn the feeder apparatus suitable for being installed on textile machines provided with at least one support creel for the bobbin of base yarn and automatic change of the spool of combined yarn, the feeder apparatus comprising:

at least one first and one second added yarn feed unit;

means for directing said added yarn; and means for coupling the added yarn with the base yarn to form the combined yarn, wherein the each added yarn feed unit consists of a reel of added yarn placed on support means in contact with a motorised feed roller such that each feed unit is provided with a feed roller and is independent from other feed units, and wherein said means for coupling the added yarn with the base yarn are a device for insertion of ends, comprising a pneumatic cylinder with a horizontal axis, and a presser element placed at a mobile end of the pneumatic cylinder, the presser element shaped like a plate and moved horizontally by a pneumatic thrust of said cylinder.

2. Feeder apparatus for the automatic insertion of added yarn according to claim 1, wherein the means for supporting the reel of added yarn are a support arm fitted with a spring release device, suitable for maintaining the reel of added yarn in contact with the feed roller.

3. Feeder apparatus for the automatic insertion of added yarn according to claim 2, wherein the added yarn is of a stretch type.

4. Feeder apparatus for the automatic insertion of added yarn according to claim 1, wherein the device for insertion of ends also comprises a U-shaped upright, attached at one end to a frame of the textile machine, and attached to a fork-shaped device at an opposite end in relation to the frame, the fork-shaped device having an inlet with an axis placed on a horizontal plane.

5. Feeder apparatus for the automatic insertion of added yarn according to claim 4, wherein said pneumatic cylinder is maintained in position at the one end by the frame, and by a bracket integral with said U-shaped upright.

6. Feeder apparatus for the automatic insertion of added yarn according to claim 4, wherein on the end of said U-shaped upright wherein said fork-shaped device is attached, a stop button with a small return spring is also attached.

7. Feeder apparatus for the automatic insertion of added yarn according to claim 6, wherein, via the inlet of the fork-shaped device, the stretch yarn of a reel of a feed unit is made to run, and a free end of the stretch yarn is blocked with the stop button so as to remain in a waiting position while the textile machine uses up the added yarn of a reel of another feed unit.

8. Feeder apparatus for the automatic insertion of added yarn according to claim 4, wherein said presser element is configured to push the base yarn inside the fork-shaped device until the base yarn touches the added yarn in a waiting position.

9. Feeder apparatus for the automatic insertion of added yarn according to claim 1, further comprising:

electronics to control the textile machine;

a relative yarn presence sensor configured to send a signal to the control electronics, when the reel of added yarn is used up, to actuate the pneumatic cylinder which moves said presser element outwards from an internal position to an external position.

10. Feeder apparatus for the automatic insertion of added yarn according to claim 1, wherein a jet of air welds the added yarn to the base yarn, which draws it with itself towards the second feed roller.

11. Feeder apparatus for the automatic insertion of added yarn according to claim 1, wherein the pneumatic cylinder is equipped with a return mechanism configured to return the presser element into an internal position.

12. Feeder apparatus for the automatic insertion of added yarn according to claim 1, further comprising:

ceramic deviators; and a ceramic conveyor, wherein said ceramic deviators and said ceramic conveyor are connected to the frame of the textile machine by means of rod-shaped elements.

13. Method for the feeding of added yarn in a textile machine provided with the feed apparatus according to claim 1, comprising the steps of:

arranging the two at least reels of added yarn and placing them on the relative support means;

arranging the added yarn of the first reel by hand and making the added yarn traverse a relative yarn presence sensor and into a relative ceramic deviator, then joining the added yarn to the base yarn;

actuating the feed rollers; and arranging the added yarn from at least one second reel, making the added yarn traverse a relative yarn presence sensor and into a ceramic deviator and inserting the added yarn in the device for insertion of ends in a waiting position.

14. The method according to claim 13, further comprising the step of:

taking at least one used-up reel of added yarn.

* * * * *